United States Patent [19]

Hideo

[11] Patent Number: 4,536,726

[45] Date of Patent: Aug. 20, 1985

[54] CIRCUIT BREAKER

[75] Inventor: Hisamoto Hideo, Owariasahi, Japan

[73] Assignee: Matsushita Electric Works, Ltd., Osaka, Japan

[21] Appl. No.: 551,991

[22] PCT Filed: Jan. 29, 1983

[86] PCT No.: PCT/JP83/00025

§ 371 Date: Sep. 29, 1983

§ 102(e) Date: Sep. 29, 1983

[87] PCT Pub. No.: WO83/02679

PCT Pub. Date: Aug. 4, 1983

[30] Foreign Application Priority Data

Jan. 30, 1982 [JP] Japan ..... 57-13625

[51] Int. Cl.[3] ..... H01H 75/12

[52] U.S. Cl. ..... 335/23; 335/35

[58] Field of Search ..... 335/8, 9, 16, 23, 35, 335/191

[56] References Cited

U.S. PATENT DOCUMENTS 3,462,716 8/1969 Yorgin et al. ..... 335/23

3,517,355 6/1970 Cole ..... 335/16

*Primary Examiner*—E. A. Goldberg

*Assistant Examiner*—George Andrews

*Attorney, Agent, or Firm*—Stevens, Davis, Miller & Mosher

[57] ABSTRACT

A circuit breaker including a mechanism comprising an on-off mechanism unit for opening or closing the electric circuit and a trip mechanism unit for cutting off the closed circuit, the on-off and trip mechanism units being coupled independently of each other and relating to each other only when the circuit breaker is tripped, but not when open or closed, thereby aiming at diminution in the time from detection of abnormality to disconnection of contacts, an increase in a distance between the disconnected contacts, and stabilization of trip characteristic, thus improving the cutoff performance.

3 Claims, 17 Drawing Figures

CIRCUIT BREAKER

DESCRIPTION

TECHNICAL FIELD

This invention relates to a circuit breaker interposed between the power source and a load so that when an abnormality is detected in the load, the power supply to the load is cut off.

BACKGROUND OF INVENTION

A conventional circuit breaker is constructed as shown in FIG. 17, in which a current flows from a terminal block 71 to terminal 77 through a stationary contact 72, a movable contact 73, a movable arm 74, a bimetal 75 and a stranded wire 76 in that order. A handle 78, as shown in FIG. 17, it tilted leftwardly and contacts 72 and 73 are in contact with each other by a link 79, a hook segment 80 and the movable arm 74, so as to be well-balanced. In this state, when a overload current flows in the circuit, the bimetal 75 curves downwardly to push down a movable magnetic plate 81 and release it from the hook segment 80, whereby the movable arm 74, link 79 and hook segment 80 are unbalanced and a spring 82 turns the movable arm 74 in the reverse direction around a shaft 83 to disconnect the contacts 72 and 73. When a short-circuit current flows, the magnetic flux generated around the bimetal 75 instantaneously attracts the movable magnetic plate 81 toward the stationary magnetic plate 84 so that the hook segment 80 disengages from the movable magnetic plate 81, thereby disconnecting the contacts 72 and 73 the same as the above. In addition, in FIG. 17, reference numeral 85 designates a tension spring interposed between the movable magnetic plate 81 and the movable arm 74, which is disposed around a stem 86 and biases the free end of movable magnetic plate 81 upwardly or away from the stationary magnetic plate 84.

In such a conventional example, however, a contact switching mechanism to open or close the contacts 72 and 73 through operation of handle 78 is not separate from the contact breaking mechanisms, such as link 79 and hook segment 73, to disconnect the contacts, but integral with each other. The hook segment 80, when the contacts are to be cut off, disengages from the movable magnetic plate 81 and at once rotates around a shaft 87 and thereafter the movable arm 74 turns. Hence, there has been a problem in that it takes a long time to actually disconnect the contacts 72 and 73 after detection of abnormal load. Also, even when the contacts 72 and 73 are intended to be disconnected with a larger gap therebetween, the gap is restricted because the handle 78 and movable arm 74 are connected through the link 79 and hook segment 80. Furthermore, the contact open-closing mechanism and contact cutoff mechanism in this example are integral with each other, whereby the contact cutoff mechanism is subjected to mechanical stress each time the handle 78 is hand-operated to open or close the contacts, especially subjected to the maximum strength in the transition from open condition to close condition, thereby having created a problem in that the mechanism is liable to be damaged.

SUMMARY OF THE INVENTION

This invention has been designed to solve the problems in the conventional example. An object of the invention is to provide a circuit breaker which is provided with a contact open-closing mechanism for switching the contacts by operating the handle and a contact cutoff mechanism for disconnecting the contacts when the load is abnormal, both the mechanisms being separate from each other, so that the contacts can be disconnected in a short time, a gap between the disconnected movable contact and stationary contact can be increased, and the mechanical stress applied to the contact cutoff mechanism when hand-operated can be reduced.

Next, an embodiment of a circuit breaker of the invention will be described in accordance with the drawings.

DESCRIPTION OF THE PREFERRED EMBODIMENTS

Figure 1:
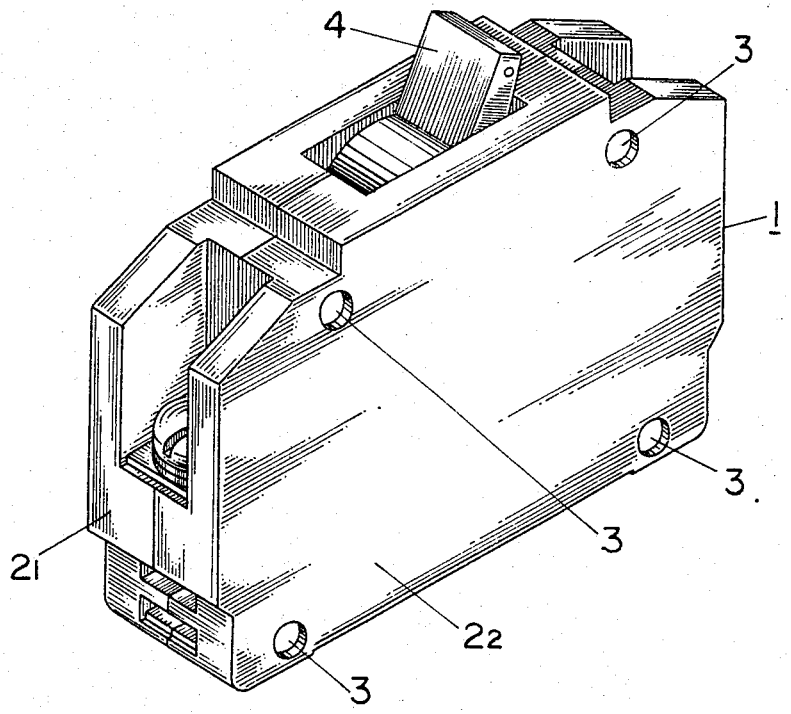
FIG. 1 is a perspective exterior view of an embodiment of the circuit breaker of the invention.
Figure 2:
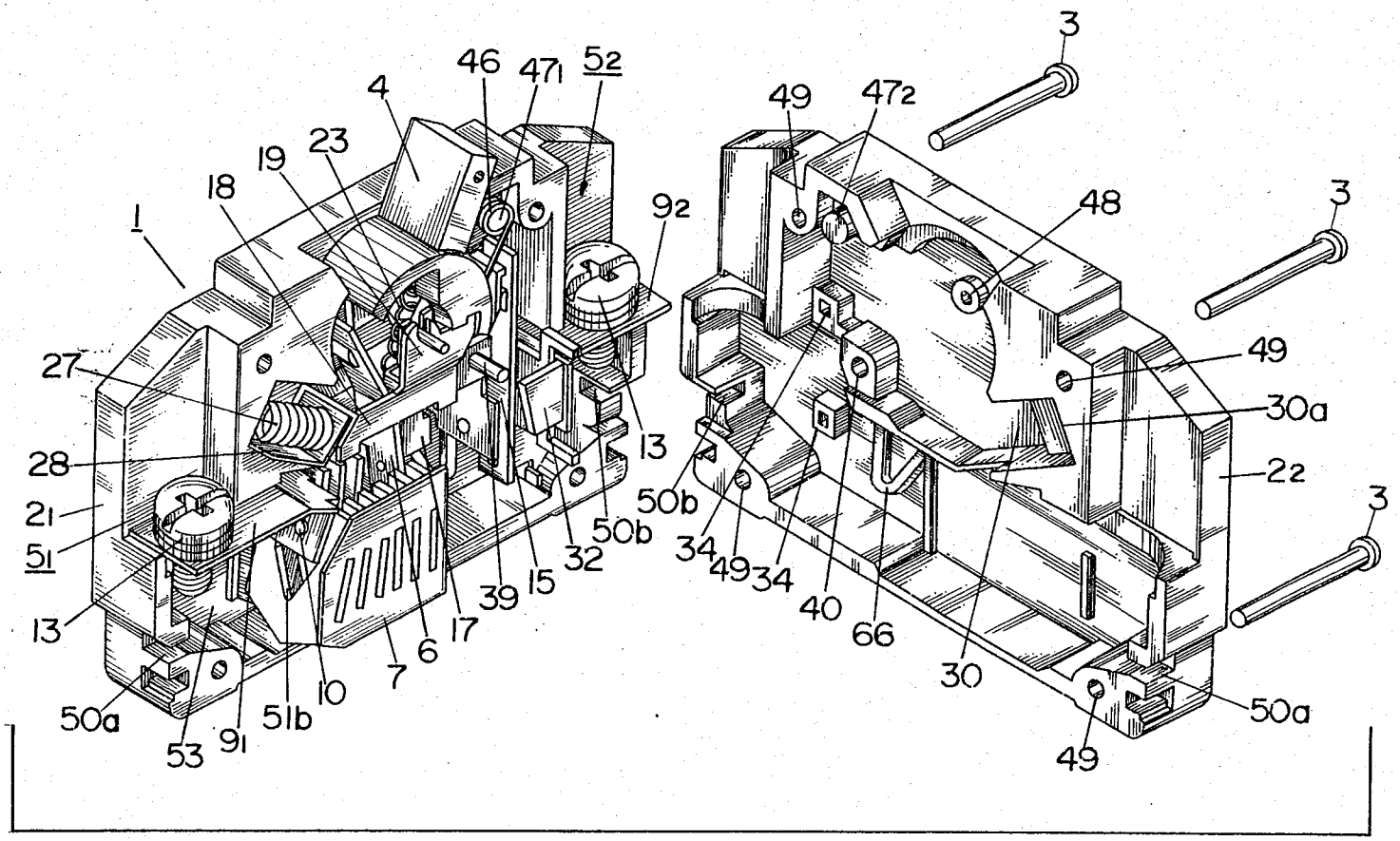
FIG. 2 is a perspective view of the FIG. 1 embodiment with the casing opened up.
Figure 3:
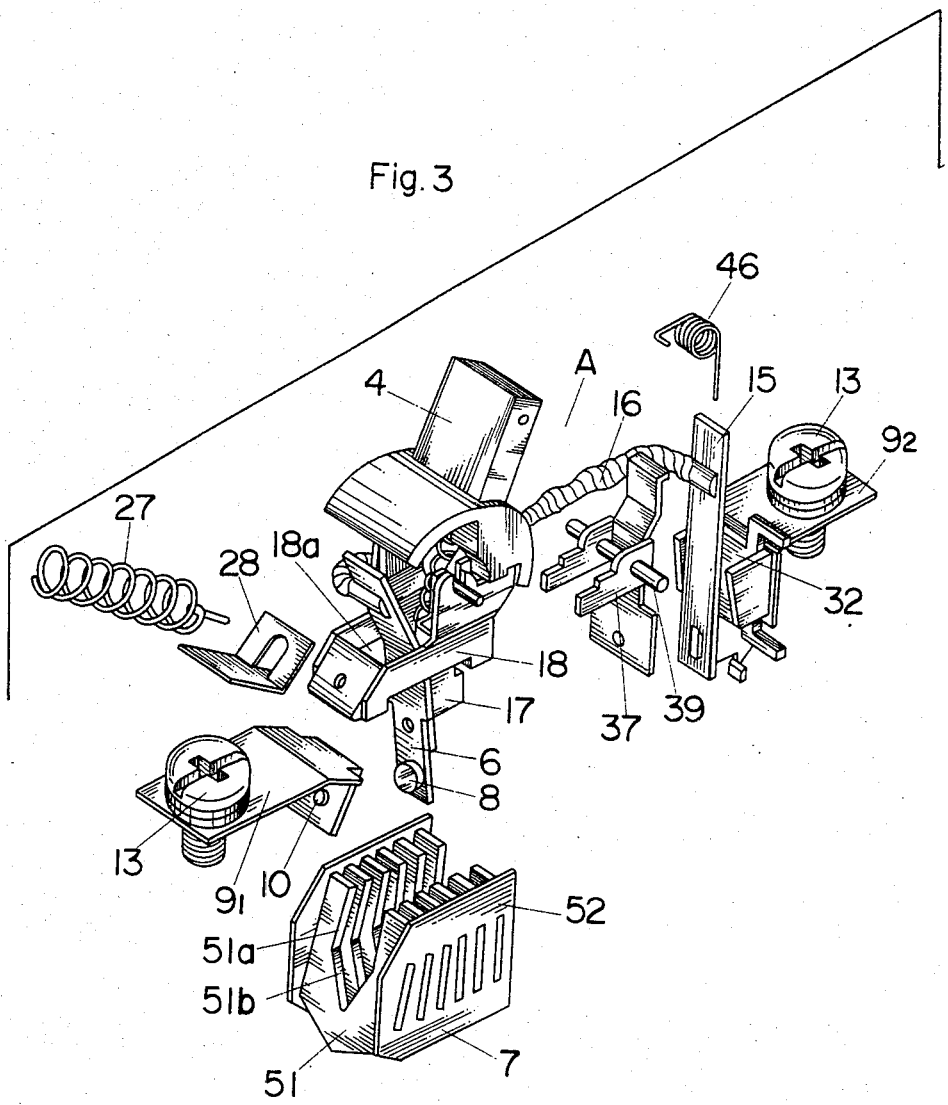
FIGS. 3 and 4 are perspective exploded views of the components of the same.
Figure 4:
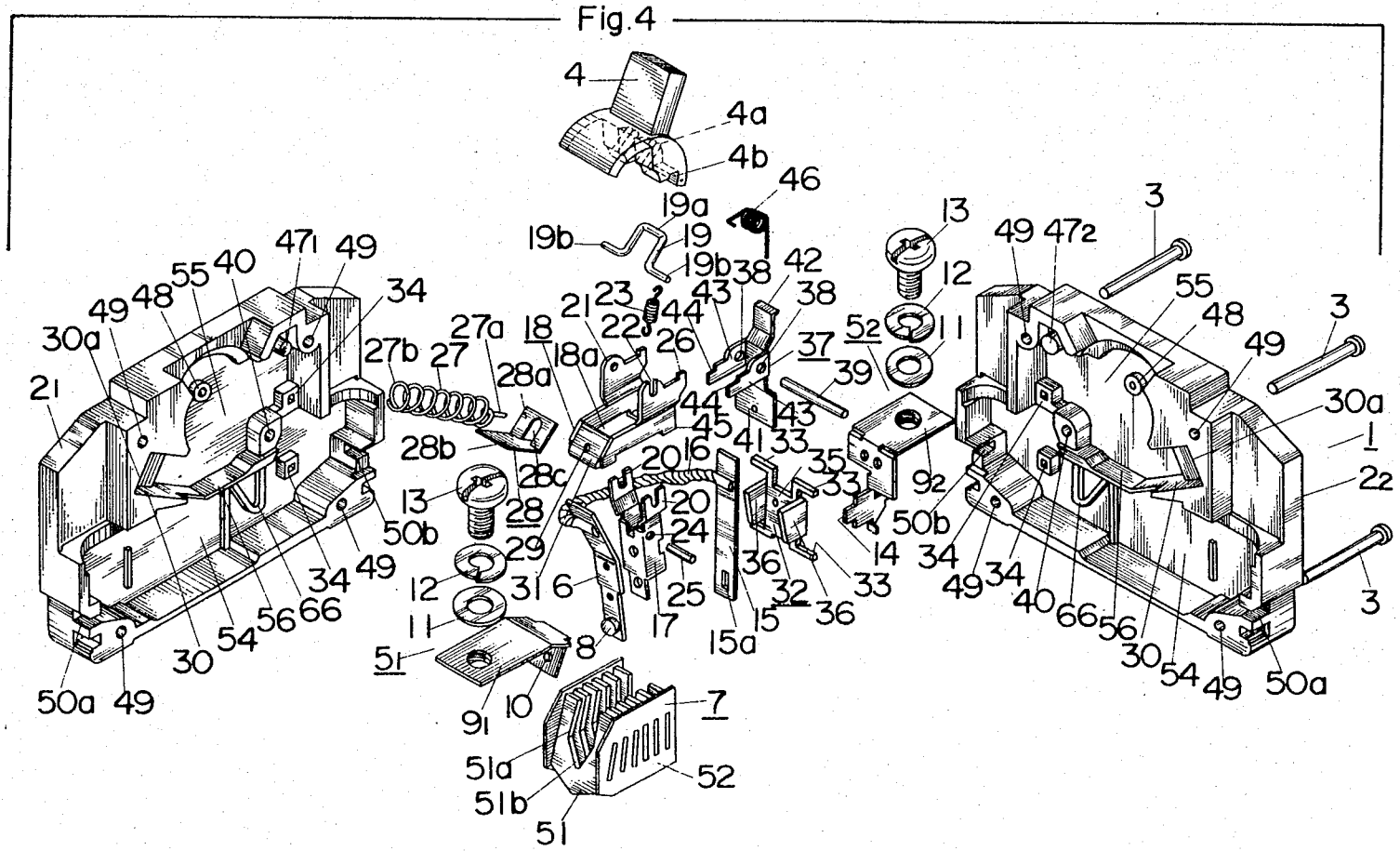
Figure 5:
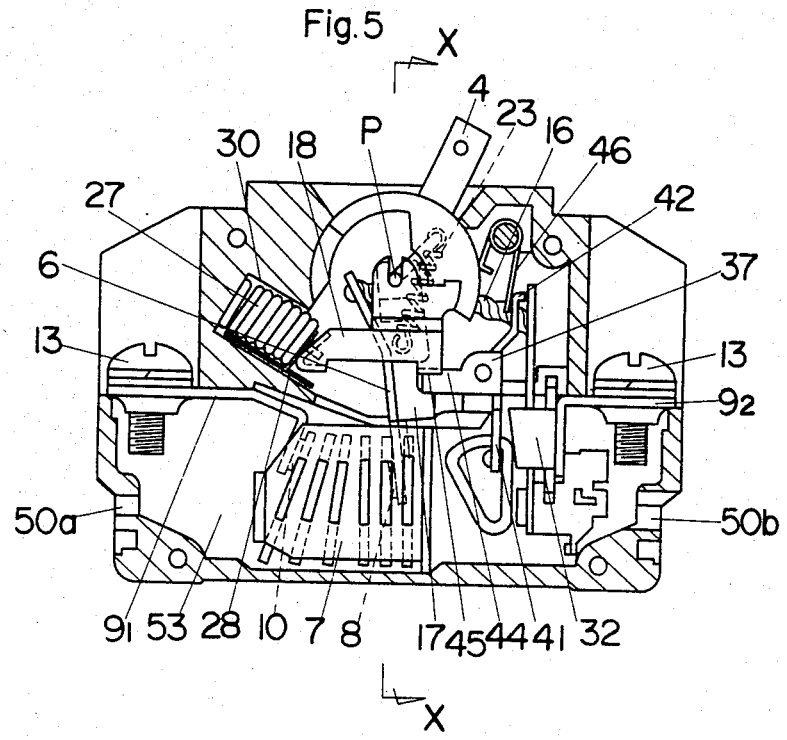
FIG. 5 is a sectional view of the FIG. 1 embodiment in the off-condition.
Figure 6:
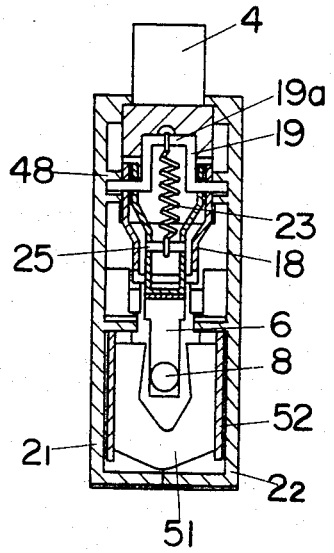
FIG. 6 is a sectional view taken on the line X—X in FIG. 5.
Figure 7:
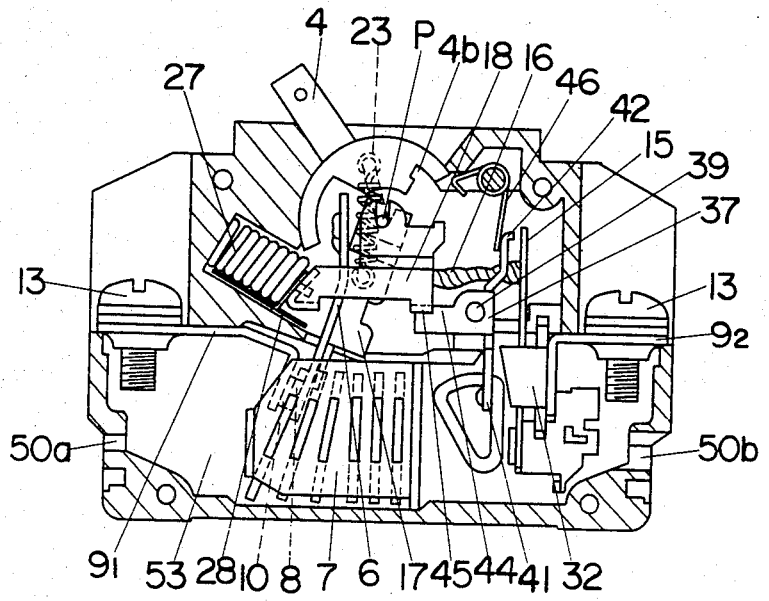
FIG. 7 is a sectional view of the circuit breaker in the on-condition.

FIG. 1 is an exterior view of the circuit breaker, in which a body 1 of the circuit breaker comprises a pair of casings $2_1$ and $2_2$ fixed by means 3, such as screws or rivets, and has at the upper surface a handle 4 projecting therefrom and for switching the circuit. FIG. 2 shows the circuit breaker from which the fixing means 3 are removed and one casing $2_1$ is removed from the other $2_2$. Between the casings $2_1$ and $2_2$ are housed various parts, such as a pair of external connection terminals $5_1$ and $5_2$, a movable contactor 6 and an arc extinguish unit 7. FIGS. 3 and 4 show parts necessary for operation of circuit breaker, and FIGS. 5 through 8 show the circuit breaker in section. In the above drawings, reference numeral 8 designates a movable contact mounted to the utmost end of movable contactor 6. The movable contact 8 contacts with or disconnected from a stationary contact 10 mounted at one terminal block $9_1$ thereby enabling the main circuit to be switched. To the terminal blocks $9_1$ and $9_2$ are mounted tightening screws 13 through washers 11 and spring washers 12 respectively to form a pair of external connection terminals $5_1$ and $5_2$. A projection 14 projecting from the terminal block $9_2$ is fitted into a bore 15*a* at the excess current detection bimetal 15 and secured thereto and the bimetal 15 is fixed to the terminal block $9_2$. A stranded wire 16 welded at one end to the free end of bimetal 15 is welded at the other end to the movable contactor 6 which is secured to a movable arm 17 fitted into the bottom opening 18*a* of a movable frame 18. 19 designates a rotary shaft pivoted to the handle 4, movable arm 17 and movable frame 18, the rotary shaft 19 being bent at an intermediate portion to be about U-shaped and easy to fit into a groove 4*a* at the handle 4 and fitted at both ends 19*b* into U-shaped grooves 20 serving as the pivot for movable arm 17 and into a pivot bore 21 and a U-shaped groove 22 at the movable frame 18. 23 designates a tension spring for biasing the handle 4 to its on or off position. The tension spring 23 engages at one end with the central portion 19*a* of rotary shaft 19 and at the other end with a pin 25 supported at both ends thereof to a shaft bore 24 at the movable arm 17. Hence, the handle 4, as shown in FIGS. 5 and 7, is adapted to be biased to the on or off position by the spring 23 on the border of the axis P of rotation of rotary shaft 19. Also, the tension first spring 23 can use its tension to integrate the movable arm 17, movable frame 18 and rotary shaft 19. A stepped portion 26 is formed at one end of movable frame 18 and engageable with a groove 4*b* at the handle 4 as shown in FIG. 4, thereby preventing the handle 4 from escaping in the direction of the arrow A during the assembly of the circuit breaker. Next, 27 designates a compression coil third spring for forcibly disconnecting the movable contactor 6 when in trip operation, the utmost end 27*a* of third spring 27 being adapted to be insertably engaged through an arc-proof protection 28 with an engaging bore 29 at spring seat 31 of movable frame 18, the third spring 27 being housed in the cavities 30 at both the casings $2_1$ and $2_2$ and the bottom 30*a* abutting against the rear end 27*b* of spring 27. The arc protector 28 prevents the spring 27 from being fused by arc generated when the movable contact 8 at the movable contactor 6 disengages from the stationary contact 10 at the terminal block $9_1$ and comprises a front protective plate 28*a* and a lateral protective one 28*b*, the front protective plate 28*a* providing an insertion bore 28*c* into which the utmost end 27*a* of spring 27 is inserted. The front protective plate 28*a* and spring seat 31 having the engaging bore 29 at the movable frame 18 are somewhat tilted for better support of spring 27. That is, the upright axes of the front protective plate 28*a* and spring seat 31 are about on the line of the center axis of spring 27. 32 designates a yoke for short-circuit current detection and formed of magnetic material. Lateral projections 33 projecting from the yoke 32 are insertably fixed into bores 34 formed at the casings $2_1$ and $2_2$ respectively, and central segment 35 at the yoke 32 is secured to the terminal block $9_2$, and side segments 36 forming the magnetic circuit extend in the same direction perpendicular to the central segment 35. 37 designates a latch plate, into bores 38 of which are inserted a pivot pin 39. The pivot pin 39 is supported at both its ends into engaging bores 40 at the casings $2_1$ and $2_2$ so that the latch plate 37 is supported rotatably thereto. The latch plate 37 is formed of magnetic material, and when an excess current flows in the bimetal 15, the magnetic flux generated therearound is applied to the central segment 35 and side segments 36 at the yoke 32 to thereby attract a magnetic attraction segment 41 at the latch plate 37 to the side segments 36. The latch plate 37 has at the upper end an abutting segment 42 to abut against the free end of bimetal 15, and stepped portions 44 are formed at the utmost ends of both side segments 43 and are to abut against the retaining portions 45 at the movable frame 17 respectively. 46 designates a twisted second spring for biasing the abutting segment 42 at the latch plate 37 toward the free end of bimetal 15, the second spring 46 abutting at one end against the rear of abutting segment 42 and at the other end against the handle 4 when in the off-position, and against the casings $2_1$ and $2_2$ when the handle 4 is in the on-position as shown in FIGS. 5 and 7, thus changing a force applied to the latch plate 37 corresponding to condition of handle 4. Also, the twisted second spring 46 is fitted at one side onto a pivot boss $47_1$ at one casing $2_1$ and at the other side onto a pivot boss $47_2$ at the other casing $2_2$, both the casings $2_1$ and $2_2$ providing bores 48 pivotally supporting both ends 19*b* of rotary shaft 19, bores 49 into which the fixtures are inserted, and exhaust bores 50*a* and 50*b* for exhausting gas generated when the circuit is cut off. 7 designates an arc extinguish unit, which comprises a plurality of arc extinguish plates (51) of magnetic material and side plates 52 of insulating material and for keeping the plates 51 spaced at proper intervals, so that the arc generated when the movable contact 8 is disconnected from the stationary contact 10, can be extinguished as quickly as possible. Each arc extinguish plate 51 has a cutout 51*a* through which the movable contactor 6 can pass, the cut-out 51*a* having at the lower end a V-like groove 51*b* so that gas staying around the contact is exhausted through the grooves 51*b* to a gas-holder 53, thereby improving the circuit breaking characteristics. Also, partitions 56 are provided between the arc extinguish chamber 54 for housing therein the arc extinguish unit 7 and the breaking mechanism unit 55, thereby preventing the arc from entering the breaking mechanism 55 from the arc extinguish chamber 54.

Next, this embodiment will be described by its operation by reference to FIGS. 5 through 8. FIG. 5 shows the circuit breaker in the off-condition, in which the movable contact 8 is disconnected from the stationary contact 10. At this time, the movable contactor 6 is biased by tension of spring 23 and moves away from the stationary contact until the contact 8 abuts against the edge of opening 18*a* at the bottom of movable frame 18. The handle 4 also is biased by the tension spring and stops in the position where the groove 4*b* engages with the stepped portion 26 at the movable frame 18. Since the twisted spring 46 is urged at one end thereof by the outer periphery of handle 4, the other end by the same intensity, biases the rear surface of abutting segment 42 against the latch plate 37. Hence, the retaining portion 45 at the movable frame 18 exactly engages with the retaining stepped portion 44 at the latch plate 37, whereby the spring 27 for trip operation is kept compressed within the cavity 30. FIG. 6 is a sectional view taken on the line X—X in FIG. 5, from which it is well understandable that the center 19*a* of rotary shaft 19 and pin 25 on the movable arm 17 are pulled each other by the tension spring 23. Next, FIG. 7 shows the circuit breaker in the on-condition, in which the movable contactor 6 is biased by tension of spring 23 and the movable contact 8 stops in the position where it is brought into press-contact with the stationary contact 10. The handle 4 also is biased by the tension spring 23 and stops in the position where its operating portion abuts against the casings $2_1$ and $2_2$. The direction of biasing the movable contactor 6 and the handle 4 operating portion, is adapted to be inverted on the border of the axis P of rotation of rotary shaft 19. When the circuit breaker is on, the twisted spring 46, as shown in FIG. 7, is not in contact at one end with the outer periphery of handle 4, so that the other end of spring 46 has less press-contact strength than in the off-condition, thereby applying to the abutting segment 42 the desired strength. As a result, in a case where the bimetal 15 is deformed by an excess current leading to press-contact with the abutting segment 42, or the yoke plate 32 is magnetized by a short-circuit current flowing in the bimetal 15 so as to attract the magnetic attraction segment 41, the latch plate 37 is free to turn around the pivot pin 39, whereby the retaining stepped portion 44 disengages from the retaining portion 45 and the spring 27 expands to turn the movable frame 18 around the axis P of rotation of rotary shaft 19.

Figure 8:
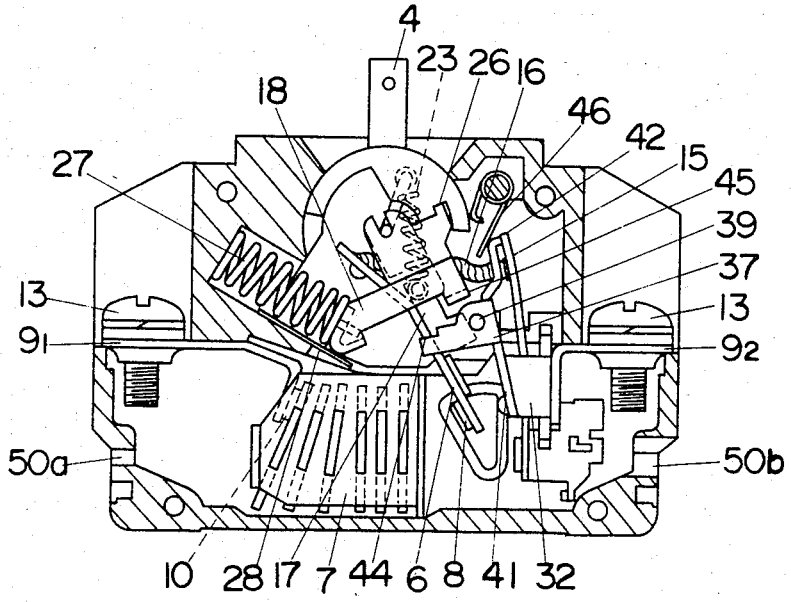
FIG. 8 is a sectional view of the same in the trip-condition.

Such a trip operation, after being carried out is shown in FIG. 8, in which the movable frame 18 is urged by spring 27 and turns so that the movable contactor 6 is pushed by the edge of bottom opening 18*a* at the movable frame 18 and forcibly driven away from the stationary contact 10. The movable contactor 6, when apart from the contact 10 at the predetermined distance, is further moved away from the same, and at last the movable arm 17 abuts against the pivot pin 39 and then stops so that the handle 4 engages at its groove 4*b* with the projection 26 at movable frame 18 and stops, at which time the movable frame 18 is slanted to stop the operating portion of handle 4 at about the center between the on and off position thereof, thereby displaying that the trip operation has occurred. Upon having carried out such trip operation, the handle 4 cannot be returned to its on-position until it is first returned to the off-position so as to reengage the stepped portion 44 with the retaining portion 45 as shown in FIG. 5. As clarified in comparison of FIG. 5 with FIG. 7, the bottom opening 18*a* at the movable frame 18 is made larger lengthwise thereof than in an on-off stroke of movable contactor 6. Hence, in a case of no trip operation as when hand-operated, the movable contactor 6 is not affected by the contact cut-off mechanism, such as spring 27, movable frame 18 and latch plate 37. Also, the twisted spring 46 in this embodiment engages with or disengages from the handle 4, so that the abutting segment 42 at the latch plate 37 is strongly urged by the spring 46 during the off-operation, whereby there is less danger that the retaining stepped portion 44 disengages from the retaining portion 45 due to vibration caused by the handle 4 when hand-operated.

Now, when the movable contact 8 is disconnected from the stationary contact 10 to cut off the main circuit, an arc is generated between the contacts 8 and 10, which is adapted to be extinguished as quick as possible by the plurality of arc extinguish plates 51 provided in the arc extinguish chamber 7. The V-shaped grooves 51*b* below the cutouts 51*a* at the arc extinguish chamber 51, as shown in FIG. 2, are disposed lower than the terminal block $9_1$, so that the gas generated around the contacts when the circuit is cut off, is adapted to be exhausted immediately into the gasholder 53 behind the terminal block $9_2$ through the grooves 51*b*, the gas in the gasholder 53 is exhausted to the exterior through a gas outlet 50*a*, thereby restricting a blow-out of arc to the exterior. Other than the outlet 50*a*, another outlet 50*b* at the reverse side to the arc extinguish unit 7, both the outlets exhausting the gas to raise the gas exhaust efficiency of extinguish unit 7.

Figure 9:
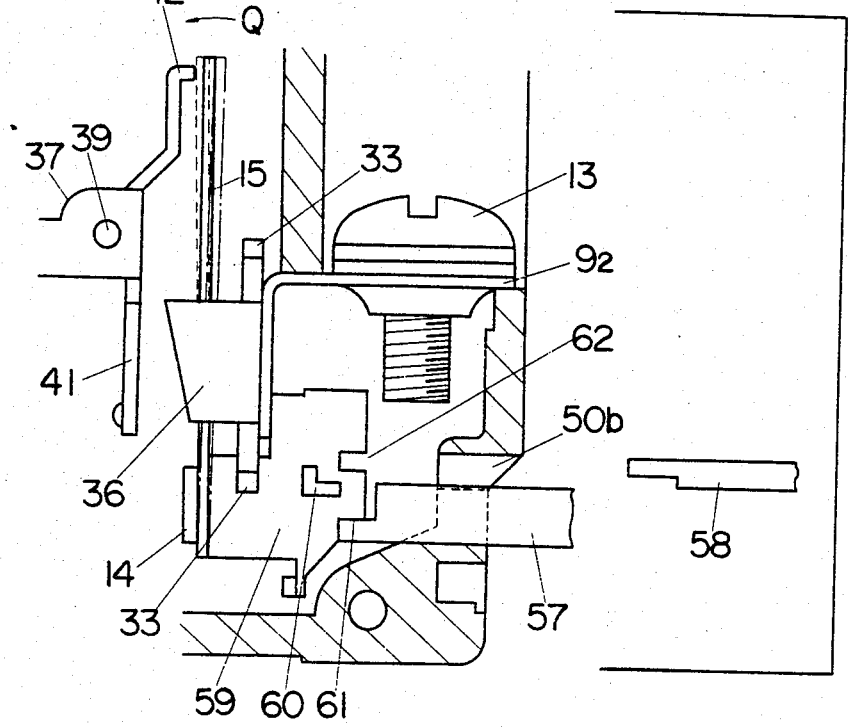
FIG. 9 is a sectional view of an adjusting mechanism for the thermal response characteristic of the bimetal.
Figure 10:
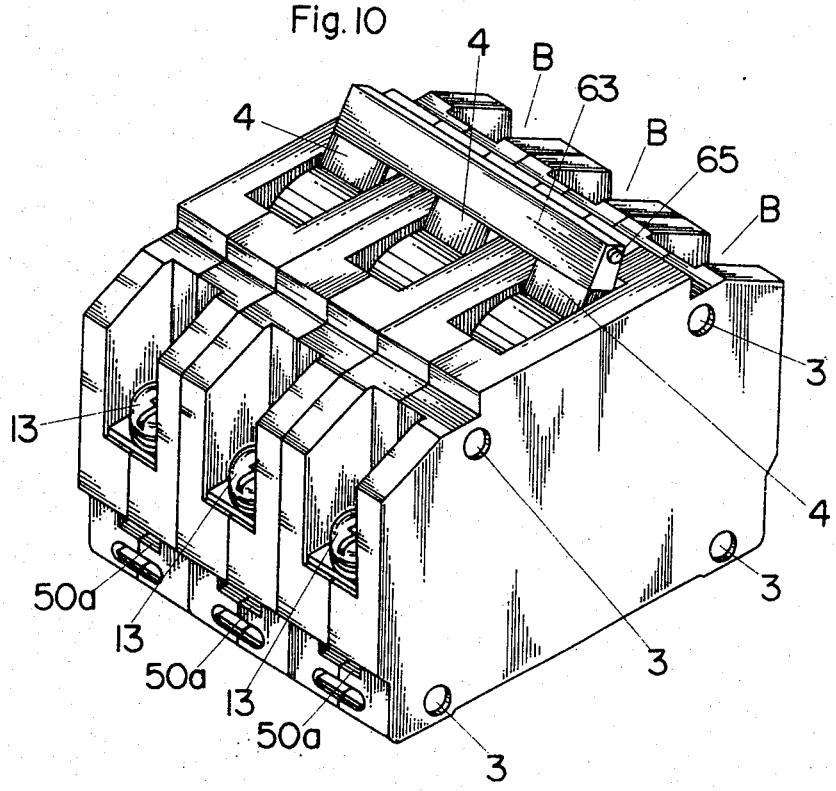
FIG. 10 is a perspective view of a modified embodiment of the invention.

Next, FIG. 9 is a sectional view of an adjusting mechanism for the thermal response characteristic of bimetal 15, in which a push-up jig 57 or a push-down jig 58 is inserted within the breaker body 1 through the gas outlet 50*b* so that the bimetal 15 may be adjusted from the exterior to change its thermal response characteristic. In FIG. 9, reference numeral 59 designates an adjusting segment formed at the lower end of terminal block $9_2$. The adjusting segment 59 has an about L-shaped opening 60, a push-up engagement 61, and a push-down engagement 62, and is provided at one end with a projection 14 onto which an engaging bore 15*a* at bimetal 15 is fixedly fitted. The terminal block $9_2$ is formed of a plate, such as copper or copper alloy sheet for better electric conductivity, so that the adjusting segment 59 is relatively easy to deform, and when the push-up jig 57 engages with the push-up engagement 61 to push the adjusting segment 59 upwardly, the opening 60 is deformed at its surrounding portions and the free end of bimetal 15 shifts in the direction of the arrow Q. When the push-down jig 58 engages with the push-down engagement 62 to push the adjusting segment 59 downwardly, the surrounding portion of opening 60 is deformed reversely, whereby the free end of bimetal 15 shifts in the reverse direction to the arrow Q. Hence, a gap between the free end of bimetal 15 and the abutting segment 42 at the latch plate 37 is desirably adjustable, thereby enabling adjustment of the thermal response characteristic of bimetal 15.

Figure 11:
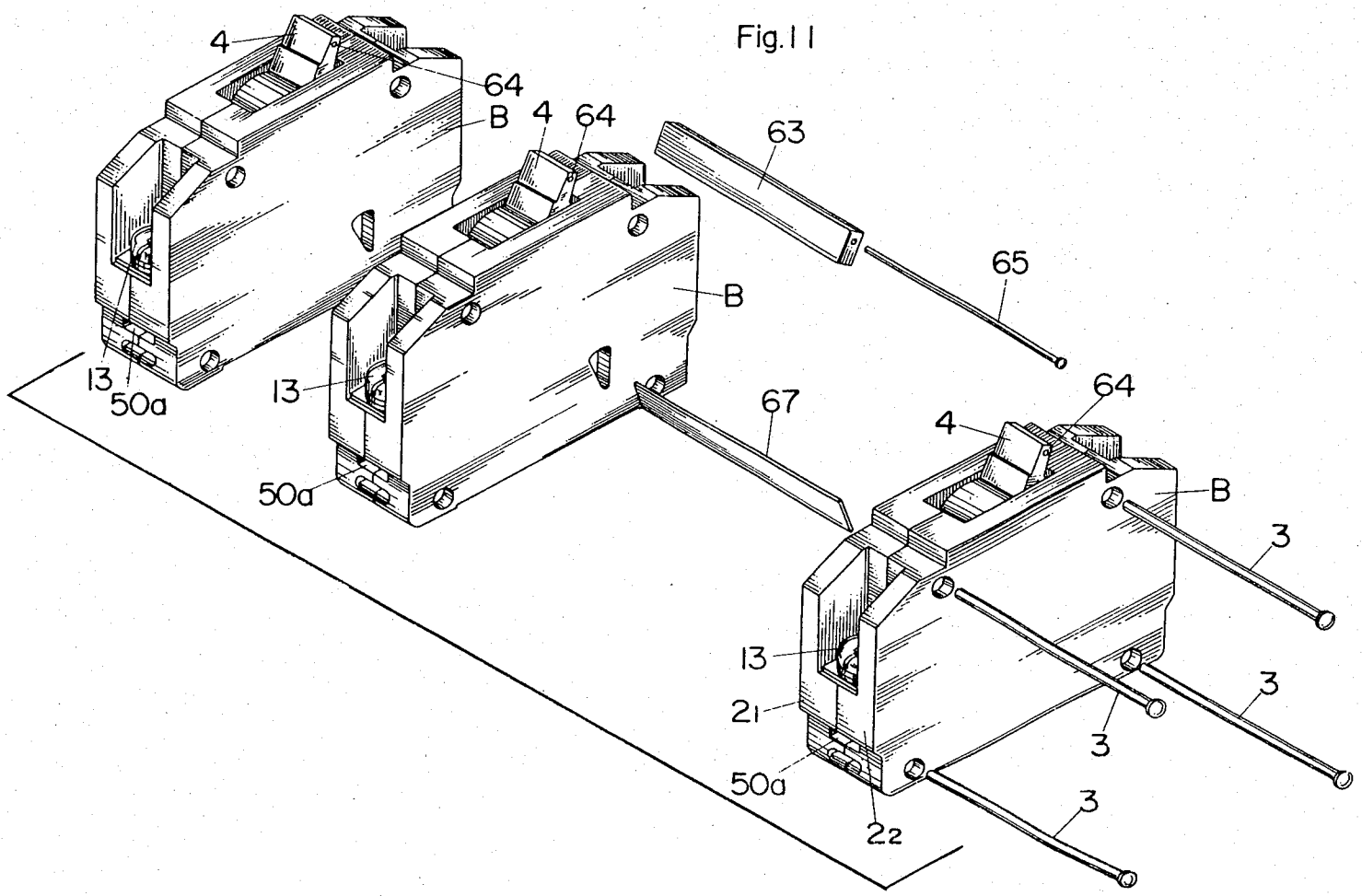
FIG. 11 is a perspective exploded view of the FIG. 10 embodiment.
Figure 12:
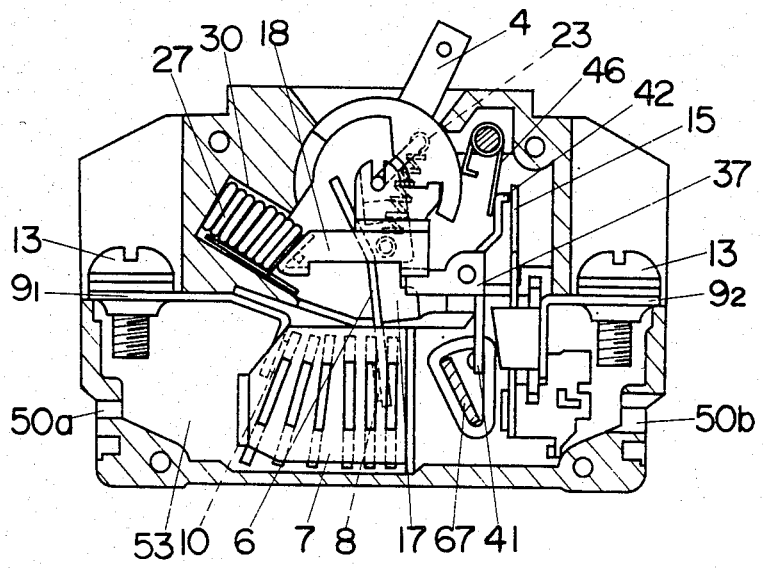
FIGS. 12 and 13 are sectional views thereof in the off-condition and the on-condition, respectively.
Figure 13:
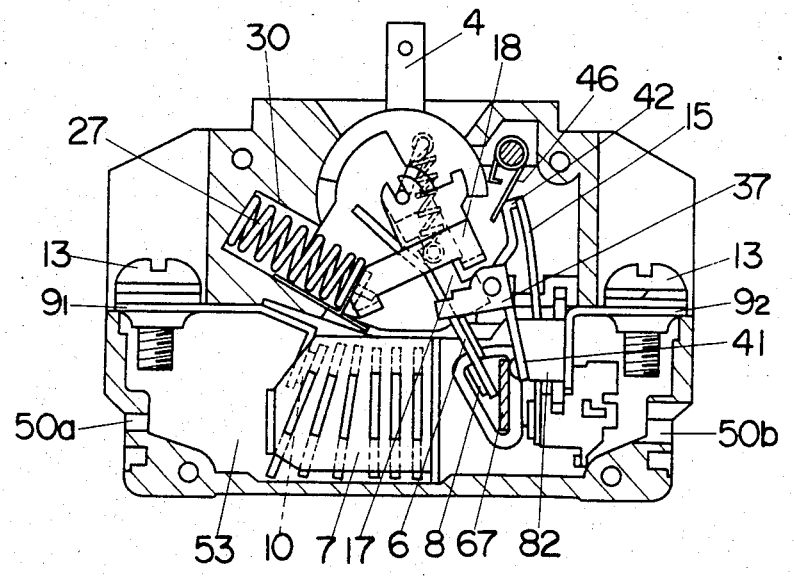

Next, a modified embodiment of the invention will be shown in FIGS. 10 through 13, in which three circuit breakers B as aforesaid are juxtaposed to constitute a three-phase AC circuit breaker, each circuit breaker B being fixed with each other by fixtures 3 as shown in FIG. 11. Each handle 4 is covered at its operating portion with a connecting cap 63 and provided at the utmost end of the same with a lateral bore 64 through which a connecting shaft 65 is inserted to interlock each handle 4. Both casings $2_1$ and $2_2$ at each circuit breaker B, as shown in FIG. 4, are provided with substantially fan-shaped rims 66 respectively, the rims 66 in this embodiment being bored at the inside, so that an interlocking plate 67 is insertable therethrough. FIG. 12 shows the movable contactor 6 in position where the interlocking plate 67 is mounted and the handle 4 is turned to its off-position, in which the movable contactor 6 is kept off the interlocking plate 67. While, FIG. 13 shows the movable contactor 6 being disconnected from the trip operation either one circuit breaker B, in which the interlocking plate 67 is urged by the movable contactor 6, so that the latch plates 37 at other circuit breakers B also are urged by the interlocking plate 67 and turn to allow the three circuit breakers B to carry out trip operations almost simultaneously.

Figure 14:
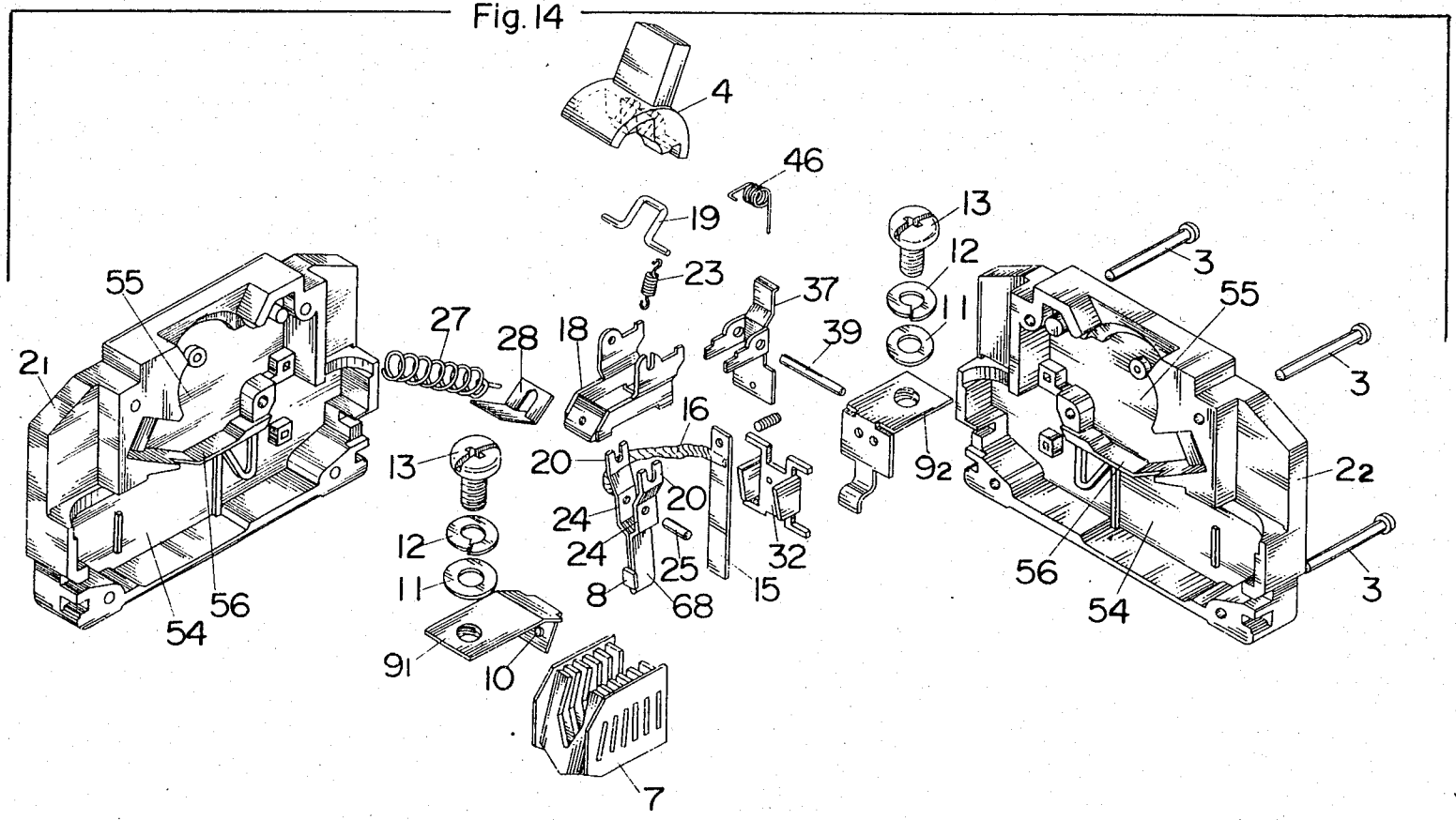
FIG. 14 is a perspective exploded view of another modified embodiment of the invention.
Figure 15:
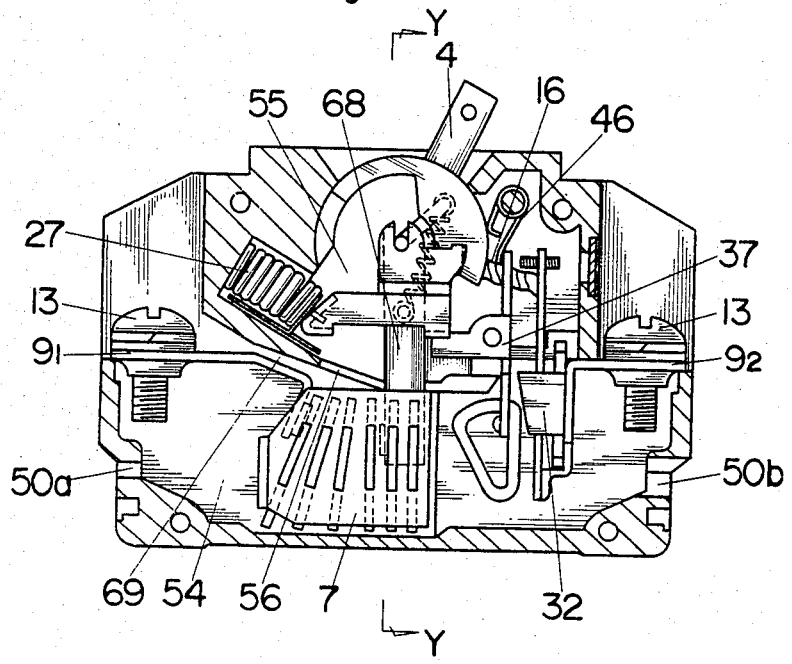
FIG. 15 is a sectional view of the FIG. 14 embodiment in the off-condition.
Figure 16:
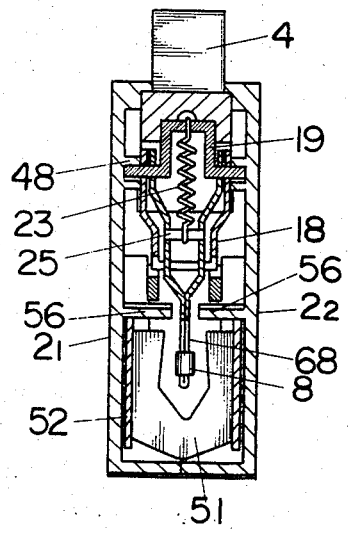
FIG. 16 is a sectional view taken on the line Y—Y in FIG. 16.
Figure 17:
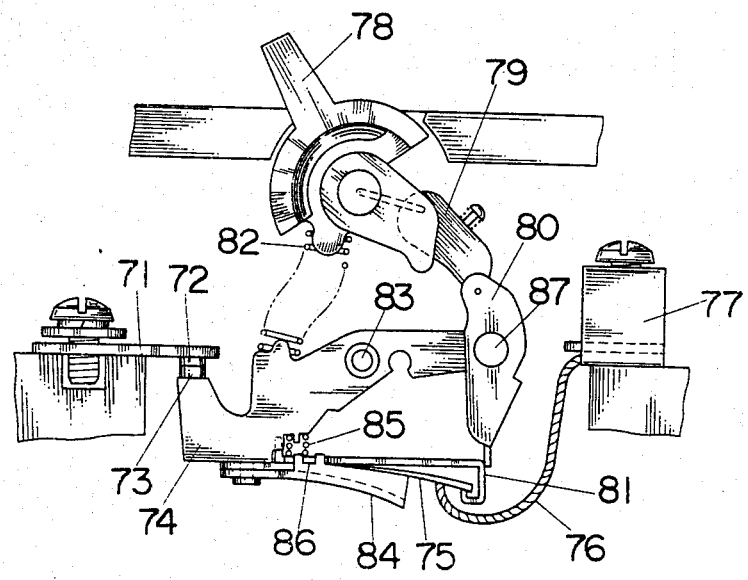
Fig. 17 PRIOR ART
FIG. 17 is a side view exemplary of a conventional circuit breaker.

Next, another modified embodiment of the invention will be shown in FIGS. 14 through 16, in which the components of the same functions as those in FIGS. 1 through 9 are designated by the same reference numerals and further of explanation is not needed. This embodiment has the movable contact 6 integral with the movable arm 17 such that a thin movable contact 68 having a U-shaped groove 20 and a shaft bore 24 serves also as the movable arm 17. Such a thin movable contactor 68 is formed of one bent copper or copper alloy sheet, or a copper or copper alloy sheet to connect with a stranded wire 16, stuck to a plate of iron larger in strength than copper or copper alloy. The former method is easy to machine and has a larger current capacity and the latter can reduce the manufacturing cost of parts because the iron sheet is inexpensive and increases the strength of movable contactor 68 because the same is stronger than the copper sheet. A movable contact 8 is mounted to one end of movable contactor 68 by welding or the like and is adapted to be brought into contact with or disconnected from the stationary contact 10. FIG. 15 is a sectional view of this embodiment of the circuit breaker of the invention, showing its off-condition, and FIG. 16 is a sectional view taken on the line Y—Y in FIG. 15. As apparent from the drawings, when the thin movable contactor 68 is used, partitions 56 between the arc extinguish chamber 54 and the cutoff mechanism unit 55 can be made larger, thereby further reliably preventing the arc generated during the disconnection of contacts from entering the cut-off mechanism unit 55. Also, since air resistance against the movable contactor 68 is smaller even in the trip operation, the quick-cutoff property can be improved. Furthermore, this embodiment is provided with an auxiliary gas outlet 69 along the partitions 56 and terminal block $9_1$, so that gas at a high temperature, generated during the shortcircuit cutoff, can quickly be exhausted to prevent insulation deterioration within the casings $2_1$ and $2_2$.

Alternatively, the overcurrent detection mechanism of bimetal 15 and the shortcircuit current detection mechanism comprising the yoke plate 32 and magnetic attraction segment 41 in the above embodiment may be replaced by a leakage current detection mechanism or an open-phase detection mechanism used as the abnormal load detection mechanism.

As seen from the above, the circuit breaker of the invention is provided with the spring for biasing the movable contactor in the direction of disconnecting the movable contact from the stationary contact and with the latch mechanism holding the spring in normal not to apply its biasing force onto the movable contactor and releasing the holding operation of the spring when an abnormal load is applied, so that when the abnormal load detection means operates to release the spring holding operation of latch mechanism, the biasing force of spring immediately drives the movable contactor in the direction of disconnecting the contacts, thereby being advantageous in that it is possible to diminish the time until the contacts actually start disconnection thereof after detection of abnormality of the load. Also, the contact open-closing mechanism comprises the movable contactor pivoted at one end and mounting on the other end the movable contact, the handle pivoted at one end and rotatably operable at the other end, the spring giving the inversion operation to the handle and movable contactor, and the movable contact and stationary contact to be in contact or disconnected by turning the handle, so that the contact open-closing mechanism is quite separate from the aforesaid contact cutoff mechanism, thereby being advantageous in that a distance between the movable contact and the stationary contact during the disconnection thereof can be set larger without being affected by the contact cutoff mechanism. Furthermore, the separation of contact open-closing mechanism from the contact cutoff mechanism prevents the contact cutoff mechanism from being subjected to mechanical stress when the contacts are hand-operated to open or close, whereby the circuit breaker is advantageous in that wear or damage of the mechanism can be reduced.

I claim:

1. A circuit breaker comprising:

a housing having two external terminals;

a handle projecting from and pivotally connected to said housing;

a movable contactor pivotally connected to said handle through a first spring means, and electrically connected to one of said external terminals and carrying a movable contact;

a stationary contactor electrically connected to the other said external terminal and having a stationary contact with which or from which said movable contact is brought into contact or disconnected;

a movable frame which is disposed movably within said housing and a latch member capable of interlocking said movable frame with said movable contactor, said latch member being disposed movably within said housing;

a second spring means normally subjecting the latch member to a spring load so as to engage said movable frame, thereby fixing said movable frame in an operable position;

an abnormality detection mechanism positioned within said housing with respect to said latch member to release said latch member and said movable frame upon detection of an abnormality; and a third spring means normally biased against said movable frame and positioned to separate said latch member from said movable frame and to apply a spring load with respect to said movable frame to cause disconnecting of said movable contactor from said stationary contactor by moving in the same direction as the usual opening thereof following movement of said movable frame from said operable position.

2. A circuit breaker according to claim 1, wherein a plurality of circuit breakers each are connected by an interlocking plate having one surface opposite to the utmost end of said movable contactor and the other surface opposite to said latch member, so that both said movable contactor and latch member abut against the surfaces of said interlocking plate, and by an interlocking rod connected to the handles of said plurality of circuit breakers for transmitting swinging motion of any of said handles to each of said circuit breakers.

3. A circuit breaker according to claim 1, wherein said spring load given to said latch member is made variable to be larger when said contacts are open then when closed.

* * * * *